US007008336B2

(12) United States Patent
Bores

(10) Patent No.: US 7,008,336 B2
(45) Date of Patent: Mar. 7, 2006

(54) ALL-IN-ONE GOLF TOOL ASSEMBLY

(76) Inventor: Robert Bores, 14756 Village Ct., Plymouth, MI (US) 48170

( * ) Notice: Subject to any disclaimer, the term of this patent is extended or adjusted under 35 U.S.C. 154(b) by 145 days.

(21) Appl. No.: 10/642,425

(22) Filed: Aug. 13, 2003

(65) Prior Publication Data

US 2005/0107190 A1 May 19, 2005

(51) Int. Cl.
*A63B 57/00* (2006.01)

(52) U.S. Cl. ..... 473/408; 473/406; 131/187

(58) Field of Classification Search ..... 473/406, 473/408, 284, 387–403; 131/187
See application file for complete search history.

(56) References Cited

U.S. PATENT DOCUMENTS 5,295,683 A * 3/1994 Tate ..... 473/406
5,305,999 A * 4/1994 Tate ..... 473/406
5,403,006 A * 4/1995 Korte-Jungermann ..... 473/284
5,706,831 A * 1/1998 Whitbeck ..... 131/187
5,755,629 A * 5/1998 Blomgren ..... 473/408
5,759,120 A * 6/1998 Mathis et al. ..... 473/408
6,004,229 A * 12/1999 Fazekas ..... 473/406
6,022,280 A * 2/2000 Arenburg et al. ..... 473/408
6,033,322 A * 3/2000 England ..... 473/408
6,357,642 B1 * 3/2002 Marchessault et al. ..... 473/406
6,413,173 B1 * 7/2002 Muller et al. ..... 473/408
6,514,159 B1 * 2/2003 Hendren ..... 473/408

* cited by examiner

*Primary Examiner*—Steven Wong
(74) *Attorney, Agent, or Firm*—Law Offices of John Chupa & Associates, P.C.

(57) ABSTRACT

An all-in-one golf tool assembly (10) having a divot repair tool (14), a decorative ball marking tool (100) which is magnetically coupled to a selectively movable portion (16). Particularly, the selectively movable portion (16) is coupled within a body portion (12) and moves from a first closed position to a second open position, wherein the second open position provides a cigar holder.

25 Claims, 2 Drawing Sheets

ALL-IN-ONE GOLF TOOL ASSEMBLY

FIELD OF THE INVENTION

The present invention generally relates to an all-in-one golf tool assembly and, more particularly, to an all-in-one golf tool assembly having a divot repair tool, a decorative ball marker, and a cigar holder which elevates a cigar off of a surface in a convenient manner.

BACKGROUND OF THE INVENTION

In the sport of golf, it is highly desirable for golfers to maintain the beauty, integrity, and playability of golf courses. It is well known that a putt may be easier to complete if the putting green is well groomed and substantially void of any divots or ball marks. For this reason, a multitude of golfers carry a divot repair tool. A divot repair tool generally comprises a relatively flat handle portion having two substantially identical "fork-like" projections which are formed from a substantially rigid and durable material, such as and without limitation, metal. These "fork-like" projections are designed to be inserted into the earth and in close proximity to a divot or ball mark. After the abovementioned insertion of the projections, the golfer simply applies pressure to the relatively flat handle portion in order to move the earth upwards towards the surface, thereby repairing a divot or ball mark.

Moreover, the sport of golf is viewed as a refined individuals' game, therefore possessing good golfing etiquette is also highly desirable. For example and without limitation, a well known "rule" of conventional golfers' etiquette is to mark a ball on the putting green whenever the ball not the furthest from the pin hole. This "rule" allows the golfer who is furthest from the hole to get a clear view of the putting green without substantially large distractions in his/her way (e.g., a foursome or a group of four golfers that have reached the green, may have four golf balls on the putting green surface while one golfer is attempting to view the lay of the ball, break of the green, inclination and slope of the green, and/or the like). For this "rule" of golfing etiquette, a ball marker, such as and without limitation to a coin or plastic disc, is carried by a multitude of golfers. The purpose of the ball marker is to remove the golf balls from the green and replace them with substantially thin profile discs, thereby allowing a golfer to view the entire green and determine the best line for the putt, as well as to putt over a ball marker rather than striking another golfer's ball while it is on the green (i.e., striking another golfer's ball while it is on the green is conventionally a two stroke penalty).

Furthermore, individuals oftentimes desire to smoke a pipe or a cigar while golfing. Golf, however, is sometimes played when the grass is wet, either from rain, morning dew, or from watering. These individuals that desire to smoke a cigar while playing golf on a wet course oftentimes cannot find a location to rest their cigar while they tee-off or otherwise hit their golf ball, thereby forcing the cigar smoking golfers to lay their cigar upon wet grass. Wet grass may undesirably extinguish or ruins the cigar, thereby forcing these golfers to either re-ignite a wet cigar or to dispose of the wet cigar and light a new cigar.

Golfers oftentimes carry an extra golf ball in their pockets, extra tees, cigarettes, lighters, and/or the like. Considering the abovementioned and carried golf tools (i.e., divot repair tool, ball marker, tees, balls, and/or the like), there may not be ample room left in the pockets of a golfer to carry a cigar holder as well.

Moreover, golfers tend to carry as few objects in their pockets as possible. That is, golfers conventionally attempt to remove any and all potentially distracting objects from their person while playing golf. For example and without limitation, most golfers remove bulky items from their pockets before attempting to hit a golf ball because the contents of a golfer's pockets may cause the golfer's pockets to project into his/her swing arc (i.e., a swing arc hereinafter refers to the generally arcuate path that a golfer causes a golf club to traverse during a golf swing), thereby disrupting his/her swing and conventionally causing the golfer to hit a poor shot.

Therefore there is a need for a golfing tool which incorporates a divot repair tool, a ball marker, and a cigar holder which elevates a cigar above a surface in a manner which allows a golfer to selectively remove a cigar from his/her mouth while hitting a ball, and which concomitantly protects the cigar from coming in contact with a surface. There is also a need for a golf tool which is relatively compact, and which incorporates a divot repair tool, a ball marker, and a cigar holder in a manner which overcomes the previously delineated drawbacks of prior golf tools.

SUMMARY OF THE INVENTION

A first non-limiting advantage of the present invention is that it provides an assembly which incorporates a plurality of golf tools in a manner which overcomes the previously delineated drawbacks of prior golf tools.

A second non-limiting advantage of the present invention is that it provides an assembly which incorporates a plurality of golf tools in a manner which overcomes the previously delineated drawbacks of prior golf tools, and which, by way of example, provides an assembly which incorporates a cigar holder.

A third non-limiting advantage of the present invention is that it provides an all-in-one golf tool that incorporates a divot repair tool, a ball marker, and a cigar holder in a relatively compact and decorative manner.

A fourth non-limiting advantage of the present invention is that it provides an assembly comprising a cigar rest portion which moves from a first stored position to a second open position.

A fifth non-limiting advantage of the present invention is that it provides a golf tool assembly comprising a ground repair portion having a pair of spaced prongs; a handle portion which is coupled to the ground repair portion, wherein the prongs project away from the handle portion, the handle portion including a pair of members which project in a direction opposite to the prongs, and wherein the members define an opening within the handle portion, the opening having a certain width; and a cigar rest portion which is disposed between and pivotally coupled to the members.

A sixth non-limiting advantage of the present invention is that it provides a golf tool assembly. Particularly, the golf tool assembly comprises a first generally U-shaped portion which projects in a first direction; a second generally U-shaped portion which projects in a second direction, wherein the second generally U-shape portion is coupled to the first generally U-shaped portion, and wherein the first direction is opposite to the second direction; a selectively movable portion which moves from a first closed position to a second open position, the selectively movable portion being pivotally coupled to the first generally U-shaped portion; and a selectively removable portion having a relatively thin profile, the selectively removable portion being removably coupled to the selectively movable portion, and which abuts at least one portion of the first generally U-shaped portion while the selectively movable portion is in the first position.

These and other features, aspects, and advantages of the present invention will become apparent from a reading of the following detailed description of the preferred embodiment of the invention and by reference to the following drawings.

DETAILED DESCRIPTION OF THE PREFERRED EMBODIMENT OF THE INVENTION

Figure 1:
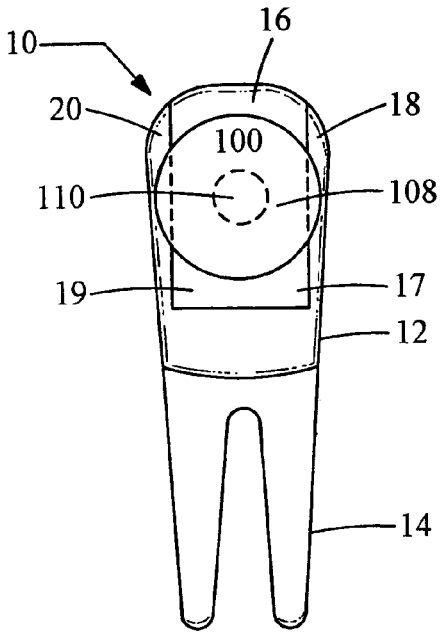
FIG. 1 is an assembled front view of an assembly which is made in accordance with the teachings of the preferred embodiment of the invention.

The present invention may be understood more readily by reference to the following detailed description of preferred embodiments of the invention.

Before the present systems and methods are disclosed and described, it is to be understood that the terminology used herein is for the purpose of describing particular embodiments only and is not intended to be limiting. It must be noted that, as used in the specification and the appended claims, the singular forms "a", "an", and "the" include plural referents unless the context clearly dictates otherwise.

Referring now to FIG. 1–6, there is shown an all-in-one golf tool assembly 10 which is made in accordance with the teachings of the preferred embodiment of the invention. As shown, the golf tool assembly 10 includes a divot repair tool 14, a decorative ball marker 100, and a movable portion 16 which cooperates with a generally "U" shaped body portion 12 and the divot repair tool 14 to perform a cigar or cigarette holding function. It should be understood that the generally "U" shaped body portion 12 is not limited to being "U" shaped. Rather, in other non-limiting embodiments of the invention, the generally "U" shaped body portion 12 may be substantially any desired geometrical configuration. For example and without limitation, the body portion 12 may be generally triangular, hexagonal, arcuate, diamond, or substantially any other geometrical configuration or shape. In this manner, the body portion may be shaped to receive and support substantially any desired cigar, cigarette, or other tobacco product.

In the preferred embodiment of the invention, the tool assembly 10 includes a generally "U" shaped body portion 12 which is formed from a relatively durable and decorative material, such as and without limitation, wood, plastic, and/or metal, and which has a certain width 40 (e.g., the width 40, in one non-limiting embodiment, is approximately one inch). The body portion 12 is coupled to a generally "U" shaped divot repair tool/ground retention portion 14 which is also formed from a substantially durable and decorative material, such as and without limitation, wood, plastic, and/or metal. Particularly, the divot repair/ground retention tool 14 includes a first end 28 which is coupled to the body portion 12 (e.g., glued) and a second end 29 which may be utilized to repair divots/ball impact marks or be utilized to penetrate a surface, such as a putting green or a tee-off box, in order to hold the tool 10 in a position which is relatively perpendicular to that surface (i.e., the second end 29 of the tool 10 is disposed into the ground or other surface while the body portion 12 is held above the ground or other surface by the divot repair/ground retention tool 14 of the tool 10), as will be discussed in greater detail below.

Figure 2:
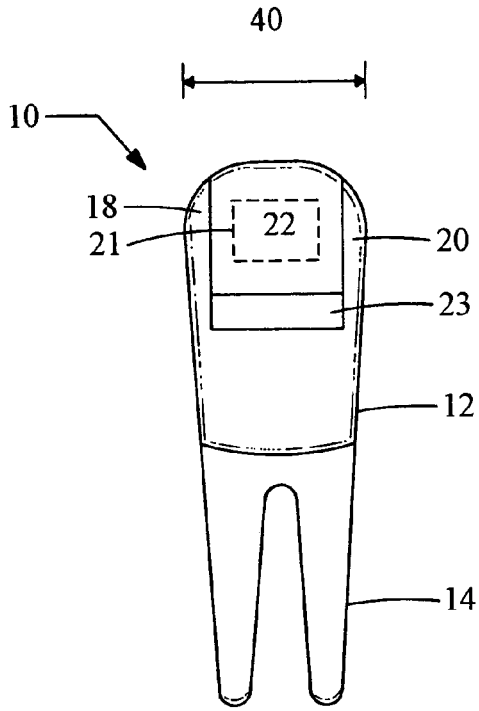
FIG. 2 is an assembled back view of the assembly which is shown in FIG. 1.
Figure 3:
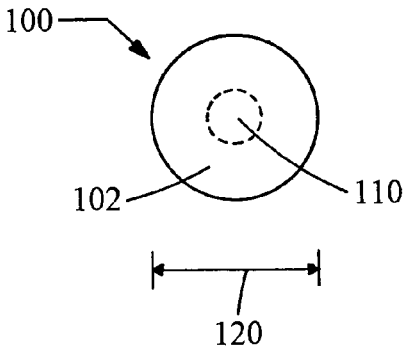
FIG. 3 is a front view of a portion of the assembly which is shown in FIGS. 1 and 2.
Figure 5:
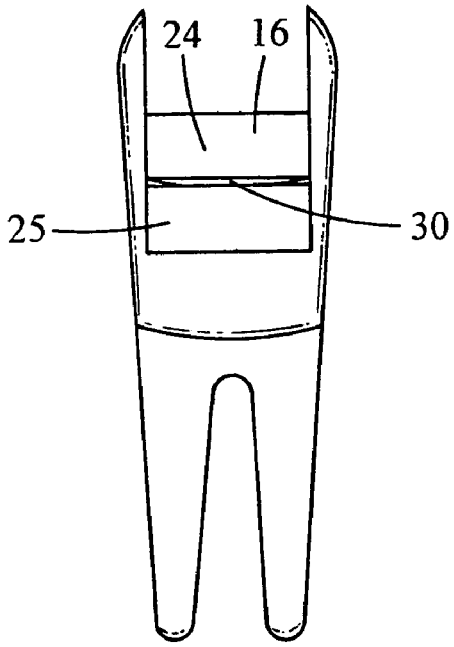
FIG. 5 is an unassembled and open front view of the assembly which is shown in FIGS. 1–3.
Figure 6:
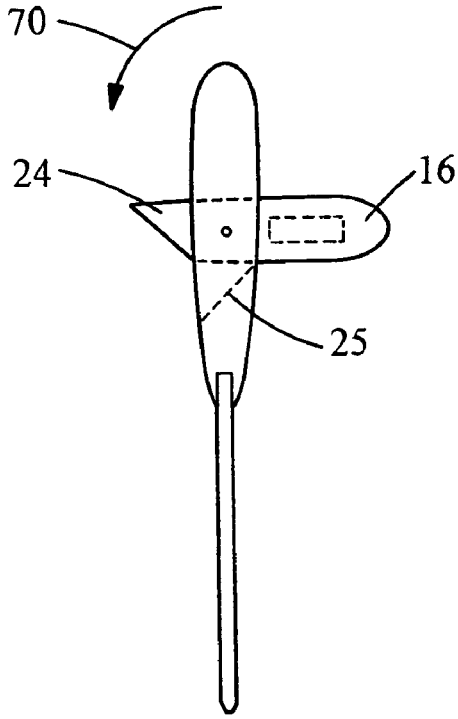
FIG. 6 is an open side view of the assembly which is shown in FIG. 5.

The body portion 12 further includes a selectively movable portion 16 which moves from a first closed or "stored" position, as shown best in FIGS. 1–2, to a second open position, as shown best in FIGS. 5–6. While the portion 16 is in first closed position, the portion 16 is contained between the sides 18, 20 of the body portion. More particularly, the body portion 12 includes a first side 18 which is movably and pivotally coupled to a first side 17 of the selectively movable portion 16 (e.g., by use of the conventional pin member 26) and a second side 20 which is movably and pivotally coupled to a second side 19 of the selectively movable portion 16 (e.g., by use of the conventional pin member 26).

The body portion 16 further includes an insert portion 22 which is made from a magnetic material, such as and without limitation, a magnet or a metal material which is attracted to a magnet (e.g., a ferrous metal). Particularly, the body portion 12, in one non-limiting embodiment, may comprise a first generally hollow half 50 and a second generally hollow half 60 and, when the first and the second generally hollow halves 50, 60 are coupled together (e.g., by use of a conventional adhesive), a generally hollow cavity 21 is created. Each half 50, 60 of the movable portion 16 may be filled with substantially any desired magnetic material, however, in the preferred embodiment of the invention, the generally hollow cavity 21 contains a conventional magnet.

The selectively movable portion 16 further includes a restrictive portion 25 having an angle which is approximately fourty five degrees. Particularly, the restrictive portion 25 cooperates with a restrictive portion 24 on the generally "U" shaped body portion 12 to prevent the movable portion 16 from moving in the direction of the arrow 70. That is, when the movable portion is within the first closed position, the cooperation of the abutting restrictive portions 24, 25 prevents the movable portion from moving to any other position, other than the second open position (i.e., the restrictive portions 24, 25 abut when the movable portion 16 is within the first closed position, thereby preventing the movable member from rotatably moving in the direction of the arrow 70).

The rotatable portion 16 further includes a ridge portion 30 which abuts with the restrictive portion 25 of the body portion 12 while the selectively movable portion 16 is in the second open position. It should be appreciated that, in this manner, the movable portion 16, while in the second open position, is maintained in a position which is generally perpendicular to the first and second sides 18, 20 of the body portion. It should be further appreciated that while the movable portion 16 is in the second position, a user of the golf tool assembly 10 may place or dispose the tool assembly 10 within a surface and the generally "U" shaped body portion 12 may be utilized to receive and contain a cigar or cigarette. In this manner, a user (e.g., a golfer) that is smoking a cigar or cigarette may dispose the tool 10 in the surface of the tee-off box, dispose a cigar or cigarette within the generally "U" shaped body portion 12 and upon the selectively movable member 16, and proceed to tee-off or hit his/her ball while concomitantly preventing the lit end of his/her cigar or cigarette from coming in contact with the surface of the tee-off box (e.g., the surface of the tee-off box may be wet from dew, rain, or sprinklers and may extinguish the lit end of the cigar or cigarette or saturate the cigar or cigarette, thereby ruining or destroying the cigar or cigarette).

It should also be appreciated that, in other non-limiting embodiments of the invention, the restrictive portions 24, 25 may comprise substantially flat (i.e., non-angled portions) which are substantially parallel to each other. That is, in this non-limiting embodiment, the portions 24, 25 will not abut, thereby allowing the selectively movable member 16 to freely pivot to the position which is shown in FIGS. 5 and 6, as well as, move in the direction of the arrow 70 (i.e., as best shown in FIG. 6).

The tool 10 further includes a selectively removable ball marker 100 which is removably coupled to the selectively rotatable portion 16. In one non-limiting embodiment of the invention, the ball marker 100 is formed from a magnetic material, such as a magnet or is formed from a material which is attracted to a magnetic material. In the preferred embodiment of the invention, the ball marker 100 is formed from a substantially rigid material, such as and without limitation, metal and includes a relatively thin magnet 110 which is disposed upon the back side 102 of the ball marker 100. That is, the back side 102 of the ball marker 100 includes a blind aperture 108 of a certain depth and the magnet 110 has a certain thickness which is substantially the same as the certain depth of the blind aperture 108. In this manner, the magnet 110 may be disposed within the blind aperture 100 and coupled to the ball marker 100 (i.e., when the magnet 110 is coupled to the ball marker 100, the back side of the magnet 110 is substantially flush with the back side of the ball marker 100).

Figure 4:
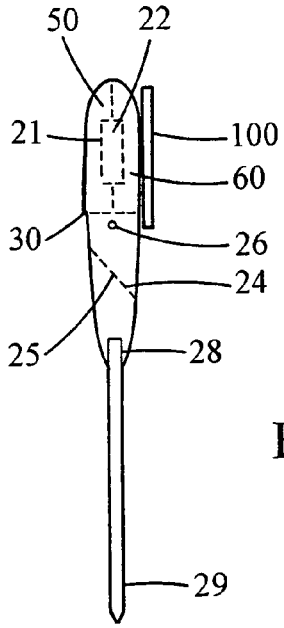
FIG. 4 is an assembled side view of the assembly which is shown in FIGS. 1 and 2.

The ball marker 100 is generally circular in shape and has a diameter 120 which is approximately equal to the width 40 of the all-in-one golf tool assembly 10. In this manner, the ball marker 100 is magnetically attracted to the selectively movable portion 16, thereby removably coupling the ball marker 100 to the selectively movable portion 100. More importantly, because the width 120 of the ball marker 100 is greater than the width of the selectively movable member 16, the magnetic attraction between the magnetic material 22 and the magnet 110 maintains the position of the selectively movable portion 16 in the first closed position. That is, the sides 18, 20 of the body portion 12 abut the ball marker 100 when the ball marker 100 is magnetically coupled to the selectively movable portion 16. In this manner, the combination of the diameter 120 of the ball marker 100 abutting the sides 18, 20 and the magnetic attraction between the selectively movable portion 16 and the ball marker 100 biases the selectively movable portion 16 in the first closed position (i.e., the position which is shown in FIGS. 1–2 and 4).

In an alternate embodiment of the invention, the golf tool assembly 10 may not include the selectively removable ball marker 100. That is, in this alternate embodiment of the invention, the golf tool assembly 10 may include a pair of conventional fastening devices rather than the ball marker 100. For example and without limitation, conventional hook and pile, conventional double-sided adhesive tape, conventional snaps, post and aperture, and/or the like may be included with the tool assembly 10. In this manner, a user of the golf tool assembly 10 may dispose at least one portion of the pair of conventional fastening devices upon the selectively movable portion 16 and dispose the remaining at least one portion of the conventional fastening devices upon substantially any desired object (e.g., a favorite ball marker, a coin, or substantially any desired object that may be utilized as a ball marker). The desired object (e.g., a coin) may then be selectively and removably coupled to the selectively movable portion 16, effective to maintain the selectively movable portion 16 within the first closed or "stored" position while concomitantly providing an object coupling means with the tool assembly 10 that allows a user to utilize substantially any desired object (i.e., substantially any desired object which is sized similarly to the ball marker 100) as a ball marker, as well as allowing the desired object to be selectively removable from the tool assembly 100.

It should be understood that this invention is not limited to the exact construction or embodiments listed and described, but that various changes may be made without departing from the spirit and scope of the invention.

What is claimed is:

1. A golf tool assembly comprising:

a ground repair portion having a pair of spaced prongs;

a handle portion which is coupled to said ground repair portion, wherein said prongs project away from said handle portion, said handle portion including a pair of members which project in a direction opposite to said prongs, and wherein said members define an opening within said handle portion, said opening having a certain width; and a cigar rest portion which is disposed between and pivotally coupled to said members, wherein said cigar rest portion is generally hollow, said assembly further comprising a magnet which is disposed within said generally hollow cigar rest portion, wherein said handle portion further includes a first angular abutting edge, and wherein said cigar rest portion further includes a second angular abutting edge, said first and said second angular abutting edges being adapted to abut, effective to prevent said cigar rest portion from moving in a certain direction.

2. The assembly of claim 1 further comprising a selectively removable ball marker, said selectively removable ball marker having a magnetic material therein, said ball marker further having a certain diameter.

3. The assembly of claim 2 wherein said certain diameter of said ball marker is larger than said certain width of said opening.

4. The assembly of claim 3 wherein said opening of said handle portion is generally U-shaped.

5. The assembly of claim 1 wherein said opening of said handle portion is generally triangular in shape.

6. A golf tool assembly comprising:

a first generally U-shaped portion which projects in a first direction;

a second generally U-shaped portion which projects in a second direction, wherein said second generally U-shape portion is coupled to said first generally U-shaped portion, and wherein said first direction is opposite to said second direction;

a selectively movable portion which moves from a first closed position to a second open position, said selectively movable portion being pivotally coupled to said first generally U-shaped portion; and a selectively removable portion having a relatively thin profile, said selectively removable portion being removably coupled to said selectively movable portion, and which abuts at least one portion of said first generally U-shaped portion while said selectively movable portion is in said first position.

7. The assembly of claim 6 wherein said first generally U-shaped portion comprises:

a body portion having a first end and a second end; a first side portion which is integrally formed with said body portion on said first end, said first side portion including an aperture;

a second side portion which is integrally formed with said body portion on said second end, said second side portion including an aperture, said first side portion being substantially parallel to said second side portion; and a first restrictive portion having a first certain angle, said first restrictive portion being formed upon said body portion and between said first and said second ends.

8. The assembly of claim 7 wherein said second generally U-shaped portion is a divot repair tool, said divot repair tool being fixedly coupled to said body portion.

9. The assembly of claim 8 wherein said selectively movable portion comprises:

a generally rectangular exterior having a top side, a bottom side, a left side, a right side, a front side, and a back side;

an aperture which is formed through said left and said right side, and which traverses through said selectively movable portion;

a generally hollow containment area which is formed within said selectively movable portion; and a second restrictive portion having a second certain angle, said second restrictive portion being formed upon said bottom side, wherein said first restrictive portion of said body portion being designed to abut said second restrictive portion of said selectively movable portion.

10. The assembly of claim 9 further comprising a first magnetic material, said first magnetic material being disposed within said generally hollow containment area of said selectively movable portion.

11. The assembly of claim 10 wherein said selectively movable portion is disposed between said first and said second side portions of said body portion, such that said apertures of said first and said second side portions align with said aperture of said selectively movable portion, and such that said first restrictive portion abuts said second restrictive portion, said assembly further comprising a pin member, said pin member being disposed through said apertures, effective to movably couple said selectively movable portion to said body portion.

12. The assembly of claim 11 wherein said magnetic material comprises a magnet.

13. The assembly of claim 11 wherein said magnetic material comprises a metal material which is magnetically attracted to a magnet.

14. The assembly of claim 11 wherein said relatively thin profile and selectively removable portion comprises a generally circular ball marker, said ball marker including at least one second magnetic material.

15. The assembly of claim 14 wherein said at least one second magnetic material comprises a magnet.

16. The assembly of claim 14 wherein said at least one second magnetic material comprises a metal which is magnetically attracted to a magnet.

17. The assembly of claim 14 wherein said at least one second magnetic material comprises:

a magnet; and a metal which is magnetically attracted to a magnet.

18. The assembly of claim 15 wherein said at least one second magnetic material of said ball marker is magnetically and removably coupled to said first magnetic material of said selectively movable portion when said selectively movable portion is in said first position.

19. The assembly of claim 18 wherein selectively movable portion moves to said second position only upon a selective removal of said ball marker from said selectively movable portion.

20. The assembly of claim 19 wherein said ball marker has a certain diameter and wherein said body portion and said first and second sides have a certain width, said certain diameter of said ball marker being substantially similar to said certain width of said body portion and said first and second sides.

21. The assembly of claim 19 wherein said first position of said selectively movable portion abuts said first and said second restrictive portions, thereby preventing said selectively movable portion from moving to a third position.

22. The assembly of claim 19 wherein said ball marker is magnetically and removably coupled to said front side of said generally rectangular exterior when said selectively movable portion is in said first position, thereby preventing said selectively movable portion from moving to said second and said third positions.

23. The assembly of claim 22 wherein said back side of said exterior further comprises a ridge portion, said ridge portion abutting said first restrictive portion only when said selectively movable portion is in said second position.

24. The assembly of claim 23 wherein said selectively movable portion is substantially perpendicular to said first and said second sides only when said selectively movable portion is in said second position.

25. An assembly comprising a ground repair portion; and a top portion which includes a pair of substantially identical sidewalls and a flat cigar portion which is disposed between and which is pivotally coupled to said pair of substantially identical sidewalls and which is movable from a first cigar supporting position in which said flat cigar portion is orthogonal to each of the said pair of identical sidewalls to a second closed position in which said flat cigar portion is substantially coplanar to the said pair of identical sidewalls, wherein said top portion includes a first angular abutting edge, and wherein said flat cigar portion further includes a second angular abutting edge, said first and second angular abutting edges being adapted to abut, effective to prevent said cigar rest portion from moving in a certain direction.

* * * * *